US010537895B2

(12) United States Patent
Svedensten et al.

(10) Patent No.: US 10,537,895 B2
(45) Date of Patent: Jan. 21, 2020

(54) CRUSHING SHELL WITH PROFILED CRUSHING SURFACE

(71) Applicant: SANDVIK INTELLECTUAL PROPERTY AB, Sandviken (SE)

(72) Inventors: Per Svedensten, Svedala (SE); Elisabeth Lee, Gothenburg (SE); Hannes Larheden, Hjarup (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 960 days.

(21) Appl. No.: 14/900,292

(22) PCT Filed: May 22, 2014

(86) PCT No.: PCT/EP2014/060512

§ 371 (c)(1),
(2) Date: Dec. 21, 2015

(87) PCT Pub. No.: WO2014/206658

PCT Pub. Date: Dec. 31, 2014

(65) Prior Publication Data

US 2016/0346786 A1 Dec. 1, 2016

(30) Foreign Application Priority Data

Jun. 27, 2013 (EP) ..... 13174042

(51) Int. Cl.
*B02C 2/00* (2006.01)

(52) U.S. Cl.
CPC ..... *B02C 2/005* (2013.01)

(58) Field of Classification Search
CPC .. B02C 2/00; B02C 2/005; B02C 2/01; B02C 2/10
See application file for complete search history.

(56) References Cited

U.S. PATENT DOCUMENTS

2006/0219830 A1 10/2006 Nilsson-Wulff et al.

FOREIGN PATENT DOCUMENTS

| | | | | |
|---|---|---|---|---|
| CN | 101905181 A | 12/2010 | | |
| DE | 1757362 A1 | 1/1971 | | |
| DE | 1810270 A1 | 3/1972 | | |
| DE | 2542660 A1 * | 3/1977 | ..... | B02C 2/005 |
| EP | 0567077 A2 | 10/1993 | | |
| SU | 1671339 A1 | 8/1991 | | |
| WO | 2006101432 A1 | 9/2006 | | |

* cited by examiner

*Primary Examiner* — Faye Francis
(74) *Attorney, Agent, or Firm* — Corinne R. Gorski

(57) ABSTRACT

A gyratory crusher crushing shell having a mount face for contacting a support region of the crusher and a crushing face to contact material to be crushed and passing through the crushing zone. The crushing shell includes a plurality of wedges project radially from the crushing surface, the wedges being spaced apart in a circumferential direction around the axis to define channels extending axially between the wedges.

18 Claims, 8 Drawing Sheets

CRUSHING SHELL WITH PROFILED CRUSHING SURFACE

RELATED APPLICATION DATA

This application is a § 371 National Stage Application of PCT International Application No. PCT/EP2014/060512 filed May 22, 20154 claiming priority of EP Application No. 13174042.5, filed Jun. 27, 2014.

FIELD OF INVENTION

The present invention relates to a gyratory crusher annular crushing shell and in particular, although not exclusively to a series of axially extending wedges that project radially at a crushing surface of the shell, the wedges being spaced apart around the axis with material flow channels defined by and positioned between each of the wedges.

BACKGROUND ART

Gyratory crushers are used for crushing ore, mineral and rock material to smaller sizes. Typically, the crusher comprises a crushing head mounted upon an elongate main shaft. A first crushing shell (typically referred to as a mantle) is mounted on the crushing head and a second crushing shell (typically referred to as a concave) is mounted on a frame such that the first and second crushing shells define together a crushing chamber through which the material to be crushed is passed. A driving device positioned at a lower region of the main shaft is configured to rotate an eccentric assembly positioned about the shaft to cause the crushing head to perform a gyratory pendulum movement and crush the material introduced in the crushing chamber. Example gyratory crushers are described in WO 2004/110626; WO 2008/140375, WO 2010/123431 and WO 2012/005651.

Primary crushers are heavy-duty machines designed to process large material sizes of the order of one meter. Secondary and tertiary crushers are however intended to process relatively smaller feed materials typically of a size less than fifty centimetres. Cone crushers represent a subcategory of gyratory crushers and may be utilised as downstream for final processing of materials. However, common to all types of gyratory crushers is a requirement to crush the material according to a predetermined reduction an as to obtain a desired particulate size of material exiting the crusher. WO 2006/101432 discloses an inner crushing shell having a series of raised crushing surfaces that project radially from the outward facing surface of the shell wall that are configured to provide a variable gap distance between the outer crushing shell to accommodate and crush a range of different sized pieces of material within the crushing zone.

One of the most common user demands on gyratory crushers is high reduction. Reduction is however restricted by limitations of energy consumption (power draw) and hydraulic pressure which are both related to the crushing force. Crushing dynamics principally involve the material pieces being trapped, compressed and then crushed in the zone between the mantle and the concave as they fall through the crusher. The crushing process is complex and the performance of the crusher is determined by a number of factors including i) the size distribution of material as it enters the crusher ii) the dynamics of the material as it is crushed and breaks; iii) the machine operating parameters including for example the close side setting (CSS), open side setting (OSS), stroke and speed and iv) the geometry of the machine and the crushing zone including in particular the gap between the concave and the mantle in to which the material falls.

One problem with existing crushers is the undesirable frequency with which the crusher 'chokes'. This occurs as the crusher allows entry of more material than what can be crushed in the lower crushing zones (below the choke point) due to limitation in the available crushing force. A result of this choking is that the force is insufficient to crush the material in the gap and the crusher can no longer retain the CSS. The crusher must then open, typically an automated process, to allow the choked material to exit the crusher and the crusher effectively reset. What is required is a gyratory crusher that addresses these problems and the disruption caused by choking.

SUMMARY OF THE INVENTION

It is an objective of the present invention to provide a gyratory crusher and at least one crushing shell being optimised to control the choke zones within the crushing chamber and to provide a crusher having a balanced capacity with increased reduction potential. It is a further objective to provide a gyratory crusher to control the flow of material passing through the crushing zone to allow the crusher to be operated at reduced close side setting (CSS) without increasing the crushing force. It is a further objective of the present invention to increase and optimise the crushing capacity of the entire crushing process particularly where a gyratory crusher is operated in a closed crushing circuit (being coupled to a downstream screen) by generating consistently crushed material having a particle or piece size within a predetermined reduction range.

The objectives are achieved by providing a crushing shell having a plurality of wedges that project radially at the shell crushing surface. The wedges are spaced apart in a circumferential direction around a central longitudinal axis (around which the shell extends) such that channels are created between the wedges at the crushing surface. The wedges act to direct the material flow into channels (that extend between the wedges) so as to control the flow of material passing through the crushing zone between the opposed inner and outer crushing shells. According to one aspect, the wedges are provided at only one of the inner or outer crushing shells. However, according to further embodiments, the wedges may be provided at both the inner and outer crushing shells.

The wedges are positioned at an axially upper region of the shell so as to extend axially downward along the body of the shell and to decrease in radial extension in the axially downward direction such that the wedges do not continue to the axially lower regions of the crushing surface. Accordingly, the wedges are intended to control the flow of material into the axially lower crushing zones between the inner and outer crushing shells. The wedges effectively decrease the overall volume within a 'choke zone' and this serves to raise the position of the choke zone axially upward in the crushing chamber. The wedges are further advantageous to reduce the amount of material being processed in the crushing chamber and to allow the crusher to be operated at a smaller CSS without a requirement to increase the crushing force. Accordingly, the reduction level of the crusher is increased together with the process capacity as the need to 'open' the crushing zone (typically via hydraulic rams) is avoided as the crusher does not experience choking as with conventional crushers.

According to a first aspect of the present invention there is provided a gyratory crusher crushing shell comprising: a main body mountable within a crushing zone defined by a frame of a gyratory crusher, the main body extending around a central longitudinal axis; the main body having a mount surface for positioning opposed to the frame or a crusher head movably mounted within the crushing zone and a crushing surface to contact material to be crushed, a wall defined by and extending between the mount and crushing surfaces, the wall having an axially upper first end and an axially lower second end; a plurality of wedges projecting radially at the crushing surface and distributed in the circumferential direction around the axis, each wedge extending axially downward from a region of the first end; characterised in that: each wedge is terminated in the circumferential direction by a pair of lengthwise shoulders; the shell further comprising a plurality of axially extending channels defined by and positioned in the circumferential direction between the shoulders of opposed wedges.

Accordingly, the radial distance of the crushing surface relative to a central axis of the shell increases and decreases according to an alternating profile in a circumferential direction around the axis at an axial position of the wedges and channels. The circumferentially extending alternating profile of the crushing surface at the axially upper region of the shell is effective to control the volume of material that is fed to be axially lower crushing region (between the opposed inner and outer crushing shells). That is, the radially extended shell walls at the region of the wedges feed material into the channels to effectively raise axially the choke point of the crushing zone. This is advantageous to avoid undesirable and premature choking of the crusher. The decreased area function (due to the presence of the wedges) within the crushing zone is effective to allow for a greater reduction whilst maintaining and optimising the particle size distribution exiting the crusher. Accordingly, the need to 'open' the crushing zone to purge the crusher is avoided.

Preferably, the wedges extend axially downward from a region substantially at or immediately below the first end. Preferably, the wedges extend axially to a region substantially halfway between the first and second ends or above the halfway region. Accordingly, an axially lower region, and optionally an axially lower half of the crushing shell, is devoid of wedges and channels. This provides that the lower region of the crushing zone is optimised for crushing material according to the CSS.

Optionally, each of the wedges may comprise a radial thickness that decreases in a direction from the first end to the second end. Optionally, the shell wall may comprise a radial thickness that decreases at a region of each wedge in the axial direction from the region of the first end to the second end. Preferably, the shell wall comprises a radial thickness that is substantially uniform at the region of each wedge in the axial direction from the region of the first end to the second end. This is advantageous to provide a uniform cooling rate at the shell wall which in turn eliminates or reduces porosity of the cast material. Preferably, a radial distance between the crushing surface of each wedge and the crushing surface of each channel decreases in an axially downward direction from the region of the first end to the second end.

Preferably, each of the wedges comprise a tapered shape profile in the axial direction such that a radial extension of the wall at a region of each wedge is greater at an axially upper region of each wedge than an axially lower region of each wedge relative to the central axis. This reducing tapered radial extension of the wedge from the central axis (and importantly each neighbouring channel) provides a smooth transition for material flowing from the axially upper to the axially lower crushing zones. Optionally, the crushing surface at the region of each wedge comprises a concave shape profile in the axial direction. That is, the effective difference in the radial extension of the wedge crushing surface relative to the radial position of the crushing surface at each channel decreases to zero so as to provide a smooth transition onto the axially lower crushing surface.

Preferably, a radial thickness of each wedge, or a radial thickness of the wall at the region of each wedge is substantially uniform in a circumferential direction between the shoulders. Optionally, a radial thickness of each channel, or a radial thickness of the wall at the region of each channel is substantially uniform in a circumferential direction between the shoulders.

The shoulders of each wedge may be defined as the radially extending surfaces that terminate each circumferential end of the crushing surface at the region of each wedge. That is, the shoulders may be considered to comprise the end faces of each wedge that define the intermediate channels that are radially recessed relative to the wedges.

According to the preferred embodiment, the shoulders (end surfaces) of each wedge, that define each channel, are substantially uniform in shape and configuration such that each lengthwise edge of each wedge, and therefore each channel, is substantially identical. In particular, the tapered profile of each side surface of each wedge, at each side of each wedge, is substantially the same or identical. Accordingly, each channel is defined and bordered by a side surface of each wedge that is substantially the same or identical. Preferably, each shoulder comprises a pair of axially extending lengthwise side surfaces, each side surface having a tapered shape profile in the circumferential direction to provide a smooth transition with a respective channel. The tapered shape profile of the lengthwise side surfaces of each wedge is configured to provide a smooth transition for material flow from the surface of the wedge into the intermediate channel for the subsequent controlled feed to the lower crushing zone. Preferably, the sides (or shoulders) of the wedges are also tapered in the axial direction so as to decrease to zero at approximately the mid-region between the upper and lower ends of the shell.

Optionally, a width of each channel in the circumferential direction around the axis is substantially equal to a width of each wedge in the circumferential direction around the axis. Optionally, a width of each wedge in a circumferential direction around the axis and between the shoulders increases in the axial direction from the first to the second end. Optionally, a width of each wedge in a circumferential direction around the axis and between the shoulders is substantially uniform along the axial length of the wedge in a direction from the first to the second end. Optionally, a width of each channel in a circumferential direction around the axis is substantially equal to a width of each wedge in a circumferential direction around the axis at the same axial position.

Optionally, the shell comprises between two to ten, three to ten, three to eight or three to six wedges distributed circumferentially around the axis. Optionally, the shell comprises 3, 4, 5, 6 or 7 wedges distributed circumferentially around the axis.

According to one aspect of the present invention, the shell is an outer crushing shell for positioning opposed to the frame such that the wedges are provided at a radially inward facing surface of the shell. According to a further aspect of the present invention the shell is an inner crushing shell for positioning opposed to the crushing head and the wedges are provided at a radially outward facing surface of the shell.

According to a further aspect of the present invention there is provided a gyratory crusher comprising at least one crushing shell as claimed herein.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1:
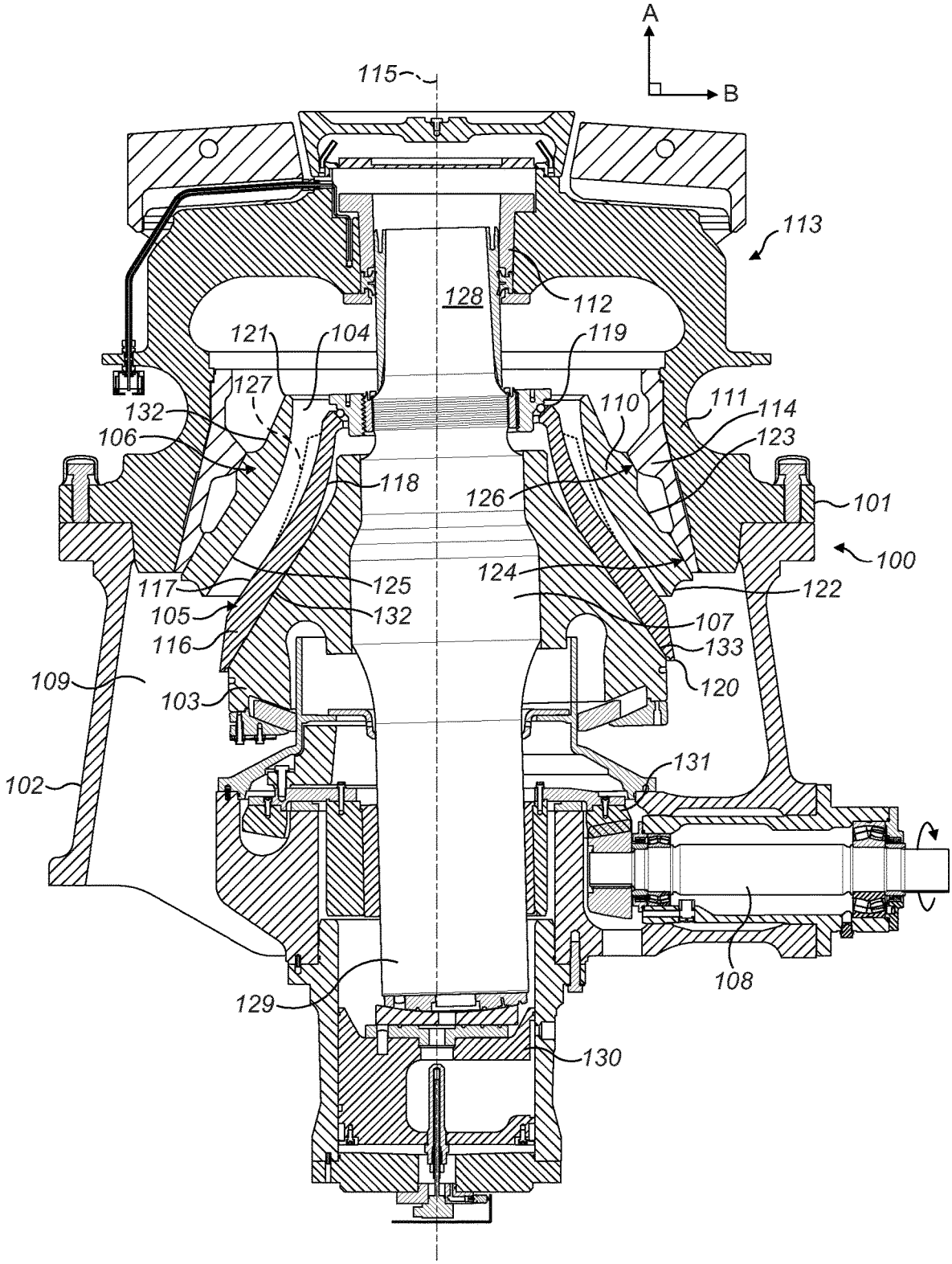
FIG. 1 is a cross sectional side view of a gyratory crusher having opposed inner and outer crushing shells with the inner shell comprising a plurality of wedges distributed circumferentially around its crushing surface according to a specific implementation of the present invention.
Figure 2:
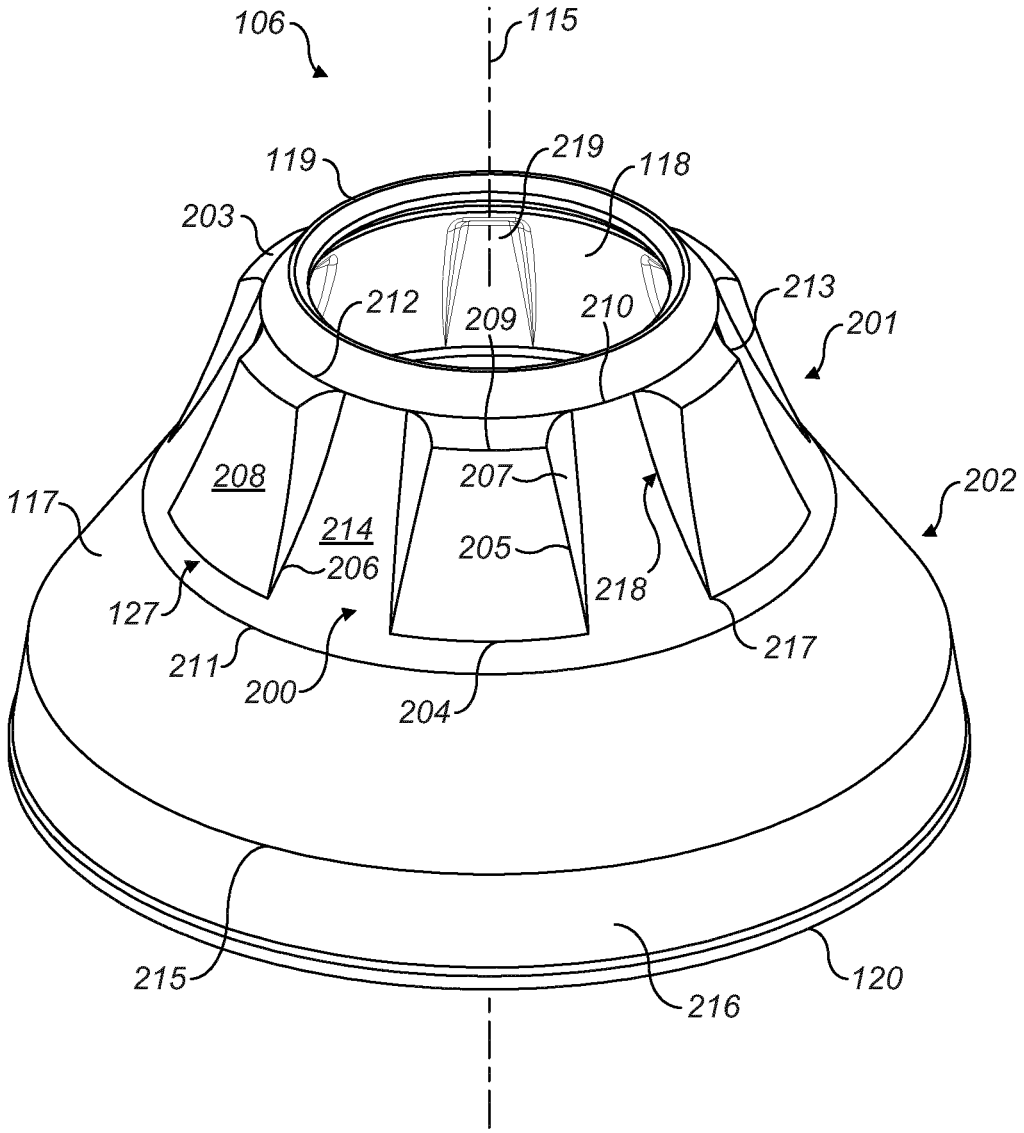
FIG. 2 is an external perspective view of the inner crushing shell of FIG. 1.

Referring to FIG. 1, a crusher comprises a frame 100 having an upper frame 101 and a lower frame 102. A crushing head 103 is mounted upon an elongate main shaft 107. A first (inner) crushing shell 105 is fixably mounted on crushing head 103 and a second (outer) crushing shell 106 is fixably mounted indirectly at upper frame 101 via an intermediate filler ring 114. A crushing zone 104 is formed between the opposed crushing shells 105, 106. A discharge zone 109 is positioned immediately below crushing zone 104 and is defined, in part, by lower frame 102.

A drive (not shown) is coupled to main shaft 107 via a drive shaft 108 and suitable gearing 131 so as to rotate shaft 107 eccentrically about longitudinal axis 115 and to cause head 103 to perform a gyratory pendulum movement and crush material introduced into crushing zone 104. An upper end region 128 of shaft 107 is maintained in an axially rotatable position by a top-end bearing assembly 112 positioned intermediate between main shaft 107 and a central boss. Similarly, a bottom end 129 of shaft 107 is supported by a bottom-end bearing assembly 130. Upper frame 101 is divided into a topshell 111, mounted upon lower frame 102 (alternatively termed a bottom shell), and a spider assembly 113 that extends from topshell 111 and represents an upper portion of the crusher.

Shell 106 comprises an annular upper end 121 and opposed lower annular end 122 with a wall 110 extending axially between ends 121, 122. Shell 106 further comprises a radially outward facing mount surface 132 and an opposed radially inward facing crushing surface 125. Similarly, inner crushing shell 105 comprises a radially outward facing crushing surface 117 and an opposed radially inward facing mount surface 118. Crushing zone 104 is defined between the crushing surface 125, 117 of the opposed shells 106, 105 respectively. Outer shell 106 further comprises a first raised upper contact region 126 and a second raised lower contact region 124, the contact regions 126, 124 projecting radially outward from the wall 110 of shell 106 so as to be axially separated and define an annular channel 123 extending circumferentially around shell 106 between upper and lower regions 126, 124. Shell 106 is configured to contact the spacer ring 114 at regions 126, 124.

Similarly, inner shell 105 comprises an annular upper end 119 and an opposed annular lower end 120 with a wall 116 extending axially between ends 119, 120. Shell 105 is mounted at head 103 via contact with an axially lower region of mount surface 118 that is seated upon a radially outward facing surface 133 of head 103.

Figure 3:
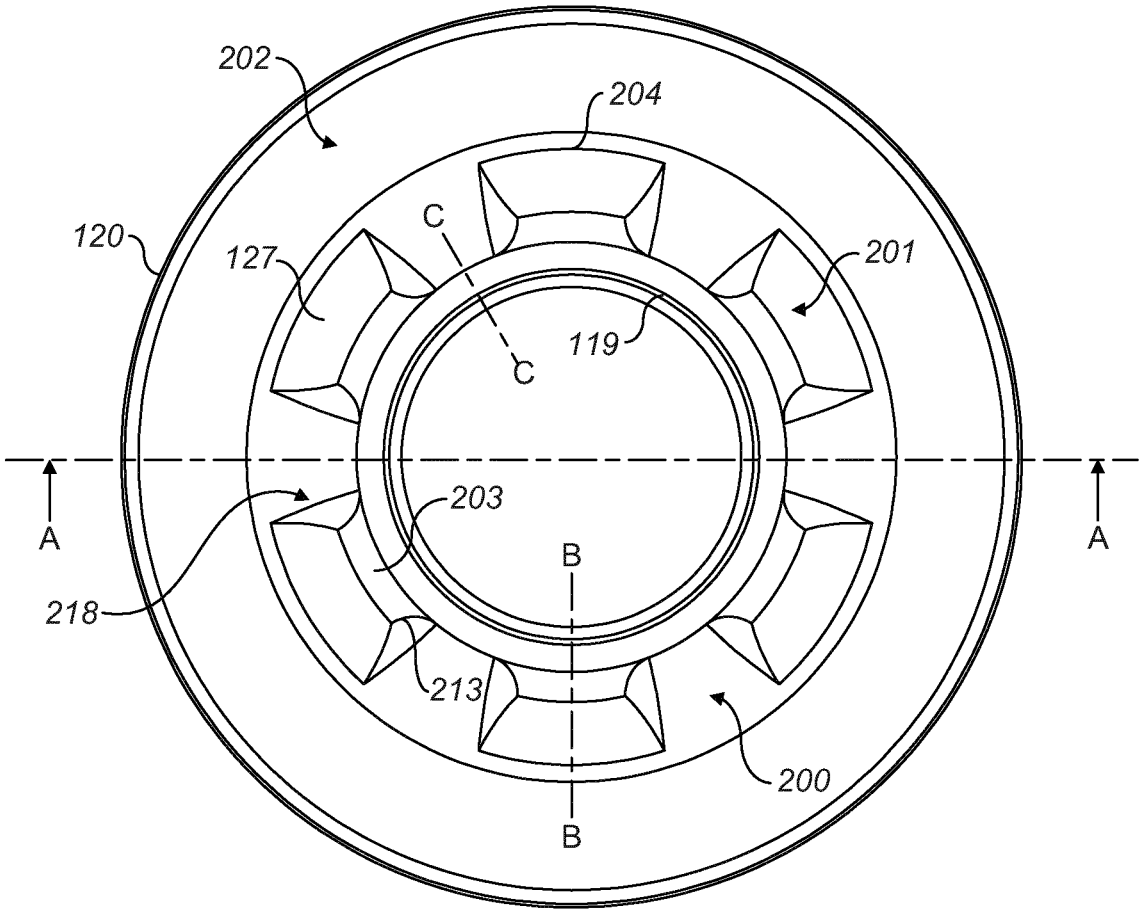
FIG. 3 is a plan view of the crushing shell of FIG. 2.

Shell 105 further comprises a plurality of wedges 127 that projects radially outward from wall 116 to represent raised ridges at the crushing surface 117. Wedges 127 project radially into crushing zone 104 from crushing surface 117 so as to reduce the volume of the crushing zone 104 at an axially upper region of shell 105 and 106. As illustrated in FIG. 1, a radial extension of each wedge 127 from axis 115 decreases in the axial direction such that the wedges 127 taper radially inward so as to diminish and effectively terminate approximately axially mid-way between upper and lower ends 119, 120. Referring to FIGS. 2 to 5 inner crushing shell 105 comprises a generally annular configuration extending around axis 115 from upper to lower annular end 119, 120 Shell 106 may be considered to be divided axially into an upper half 201 starting at upper end 119 and a lower half 202 terminating at lower end 120. An axially lowermost region of crushing surface 117 is terminated by an annular edge 215. A lowermost chamfered surface 216 extends axially between edge 215 and the lowermost annular end 120 to allow crushed material to exit crushing zone 104. Wedges 127 are positioned within upper half 201 and extend axially downward from region 212 positioned immediately below upper end 119. Each wedge 127 terminates at a lowermost region 204 at the junction between the upper and lower halves 201, 202. As illustrated in FIG. 3, shell 106 comprises, according to the specific implementation, five wedges distributed circumferentially around axis 115 and projecting radially outward from wall 116. Each wedge 127 projects radially outward at region 212 to define an upper end surface 203 extending a short distance in a circumferential direction around axis 115. Surface 203 extends a short radial distance from axis 115 and is terminated at its circumferential ends by radial edges 213. Surface 203 is defined at its radially outermost end by curved edge 209 that extends in the circumferential direction around axis 115 where a radius of curvature of edge 209 corresponds to that of upper annular end 119. Each wedge 127 is further defined by a pair of opposed axially extending lengthwise side edges 205. Each side edge 205 extends from each end of edge 209 to terminate at lowermost region 204. Aside surface 207 projects rearwardly from each side edge 205 to provide a transition to a channel 200 positioned circumferentially between each neighbouring wedge 127. The edges 205, 213 and side surface 207 collectively define a shoulder extending axially along the lengthwise side of each wedge 127. Each shoulder therefore defines the termination regions of each wedge 127 in a circumferential direction around axis 115. The shoulders 218 of neighbouring wedges 126 accordingly define each channel 200 that is recessed radially relative to each wedge 127. Each shoulder 218 and accordingly each side surface 207 of each wedge 127 are substantially identical such that each channel 200 is substantially identical in shape and configuration at both its lengthwise sides 206. Each side surface 207 comprises a concave curvature so as to provide a smooth transition between the crushing surface 208 of each wedge 127 and the crushing surface 214 of each channel 200.

According to the specific implementation, a radial thickness of each wedge 127 is greatest at its axially uppermost region corresponding to an axial position at edge 209. The 'radial thickness' of each wedge 127 is defined with reference to the radial position of the crushing surface 218 at each wedge relative to the radial position of crushing surface 214 at each channel 200. The radial thickness then decreases in the axial direction towards lowermost region 204. That is, a radial distance of surface region 204 is substantially equal to the radial distance at a lowermost surface region 211 of channel 200 (relative to axis 115) where regions 204, 211 are at the same axial position. Additionally, shell 106 comprises a plurality of recesses 219 embedded within the mount surface 118 having a position corresponding to the position directly behind wedges 127. These recesses 219 provides that the shell wall thickness is substantially uniform in the circumferentially direction around the axis. This is advantageous to moderate the cooling rate at the shell wall and eliminate material porosity of the cast shell.

Figure 4:
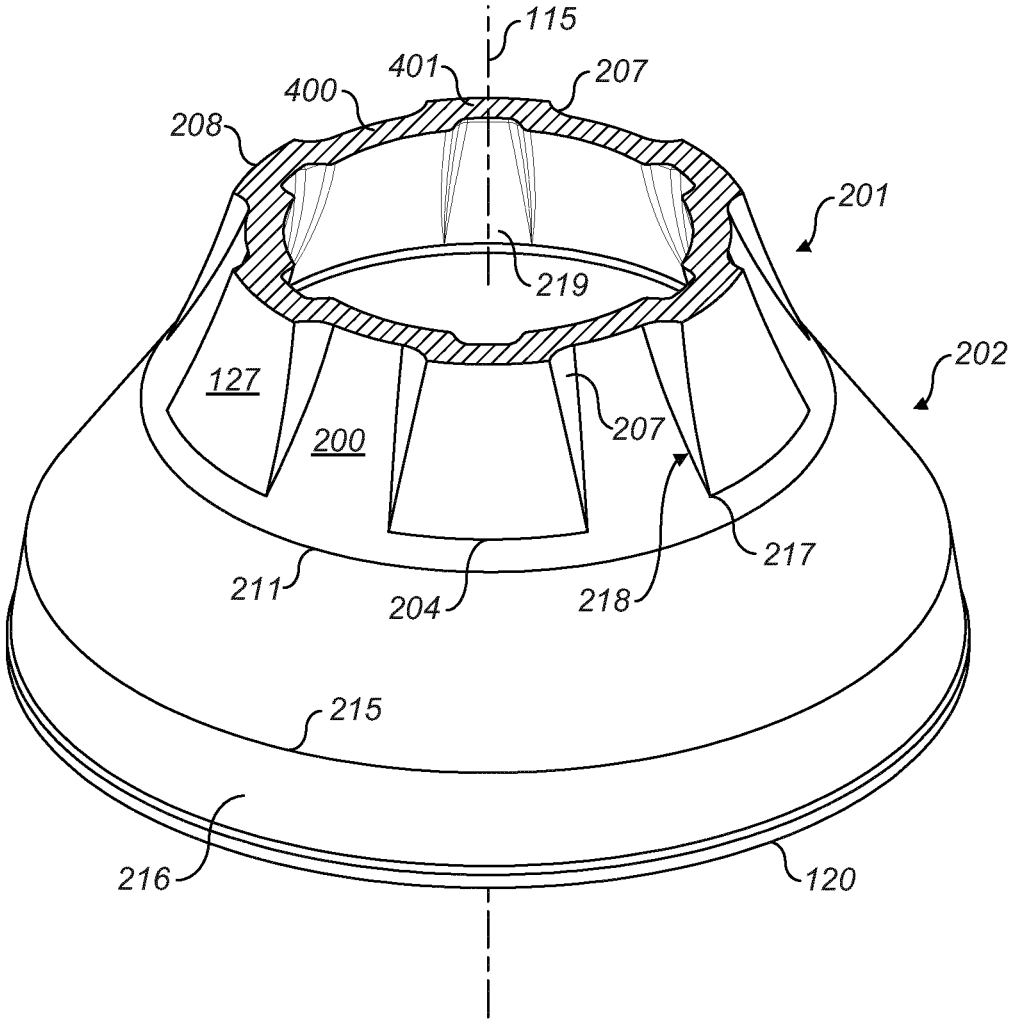
FIG. 4 is an external perspective view of the shell of FIG. 2 with a slice of an axially upper region of the shell removed for illustrative purposes.

Referring to FIG. 4, the radial distance of the crushing surface 117 relative to central axis 115 of the shell 106 increases and decreases according to an alternating profile in a circumferential direction around the axis at its uppermost half 201. That is, a radial position of the crushing surface 208 at each wedge 127 is greater than a corresponding radial position of the crushing surface 214 at each channel 200 (at the same axial position). According to the specific implementation, a width of each wedge in a circumferential direction around axis 115 is approximately equal to a corresponding width of each channel 200 at the same axial position.

Figure 5:
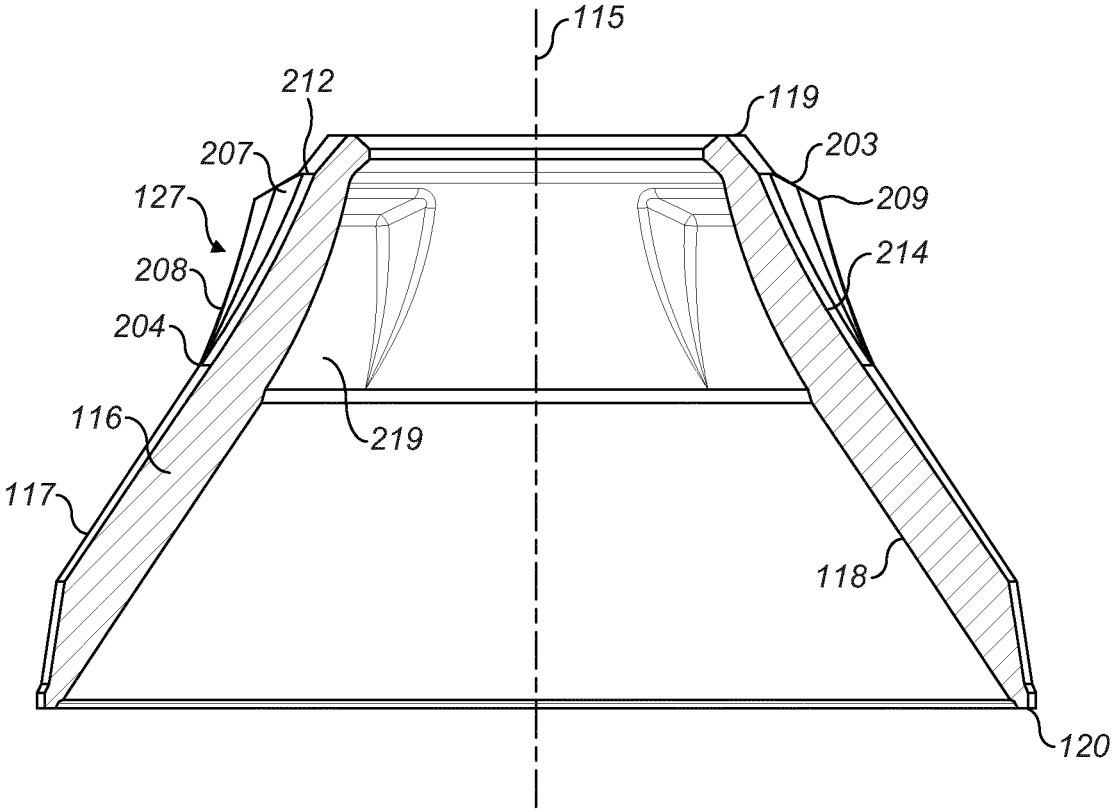
FIG. 5 is a cross sectional side view through A-A of FIG. 3.

As illustrated in FIG. 5, each wedge 127 represents a raised ridge projecting radially from the radially outward facing surface 214 of each channel 200 within the axially upper half 201 of shell 106. The radially outward facing surface 208 of each wedge 127 represents a component part of the collective crushing surface 117 of shell 106 within region 201. The corresponding surface 214 of each channel 200 also forms a component part of the crushing surface 117 within upper half 201.

Surface 208 is substantially concave in the axial direction so as to provide a smooth transition of the radial position of the crushing surface 208 at the lowermost region 204 of each wedge 127 and the lower half 202. Additionally, and as illustrated in FIG. 5, the radial thickness of each wedge 127 (relative to surface 214) decreases from the region of edge 209 to the lowermost region 204. As stated, this radial thickness of each wedge 127 is represented by the radial difference between the channel surface 214 and wedge surface 208. That is, a radial extension of each wedge 127 from axis 115 is independent of a thickness of the shell wall 116. In particular, the shell wall thickness is substantially uniform in the circumferential direction around axis 115 within the upper region 201.

As illustrated, a width in a circumferential direction of surface 208 increases axially downward from upper region 212 to lowermost region 204. Accordingly, an area of side surfaces 207 decreases axially downward from edge 213 to lowermost end 204.

Each wedge 127 is substantially symmetrical about a vertically extending plane represented as B-B. That is, a radial extension of each wedge 127 is symmetrical about the plane of B-B. Similarly, a radial extension of the shell wall 116 at the region of each channel 200 is symmetrical about a corresponding vertical plane represented by C-C.

Wedges 127 reduce the available volume of the crushing zone 104 between shells 105, 106 above the lower region 202 of shell 106. Wedges 127 are effective to guide material to be crushed into channels 200 and in contact with side surfaces 207 and channel surface 214 being positioned opposed to the crushing surface 125 of outer shell 106. In particular, wedges 127 are effective to control the delivery of the material to be crushed to the lower region of the crushing zone 104 corresponding to the lower region 202 of shell 106.

Figure 6:
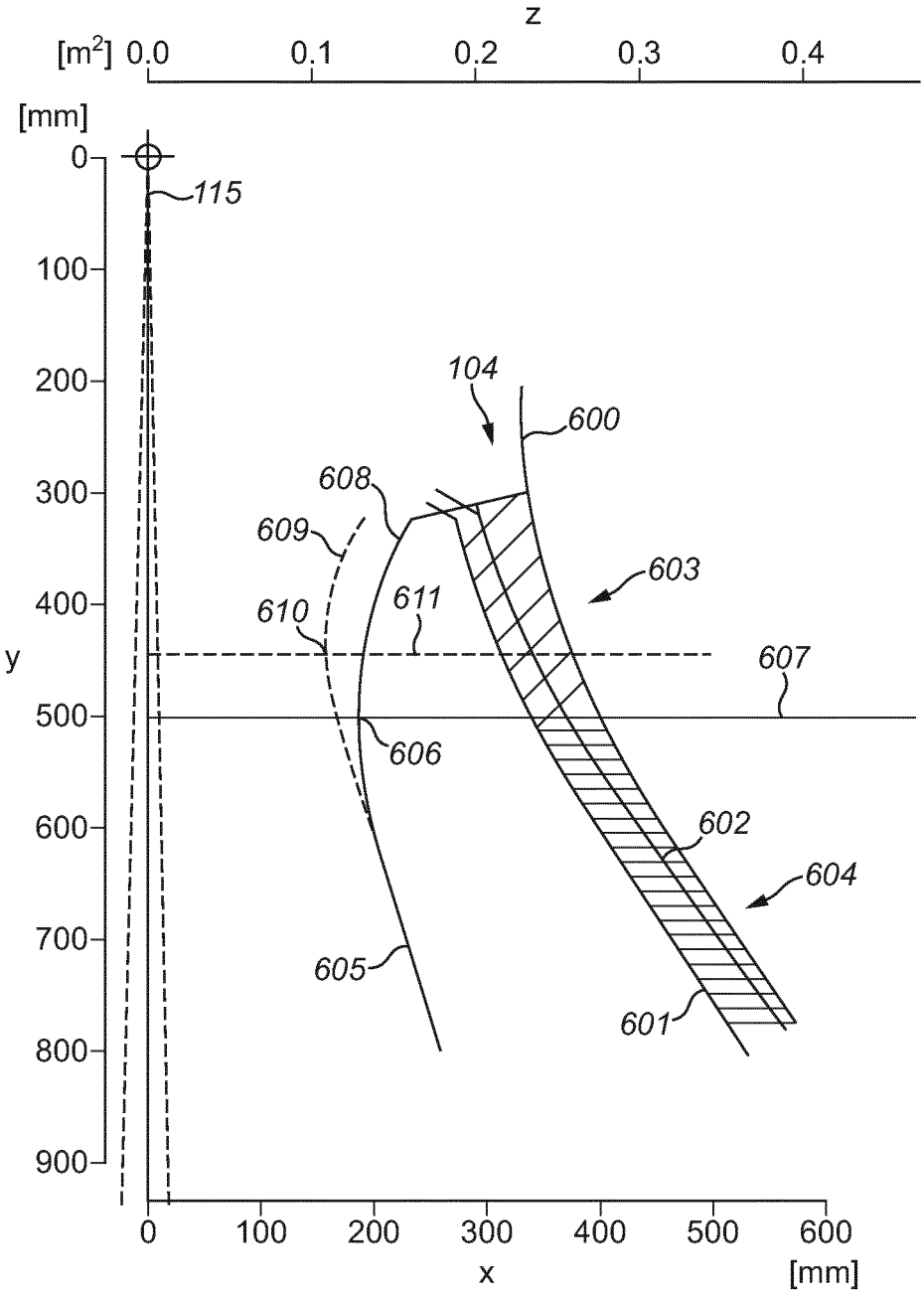
FIG. 6 is an illustration of the area function at the crushing zone between the opposed inner and outer crushing shells according to a specific implementation of the present invention.

FIG. 6 illustrates schematically a section of the crushing zone 104 where line 600 represents the shape profile of crushing surface 125 of shell 106 and line 601 represents the shape profile of the crushing surface 117 of shell 105. Line 602 represents the position of minimum separation between shells 105, 106 as head 103 oscillates about axis 115 according to the gyroscopic procession induced by shaft 108 whilst line 601 illustrates the maximum separation distance. The separation distances in the x and y axes corresponding to directions A and B of FIG. 1 and are illustrated in 100 mm intervals.

An area function at each axial position between surfaces 125, 117 is represented by line 605. A minimum 606 in the area function represents the 'choke point' of conventional crushing shells without directing wedges 127 and this is represented by line 608. According to this conventional configuration, a horizontal bisecting line 607 defines an upper crushing region 603 above choke point 607 and a lower crushing region 604 below choke point 607.

The effect of configuring shell 106 with a plurality of circumferentially spaced wedges 127 at upper region 201 is to reduce the area function and this represented by line 609. As will be noted, the choke point is accordingly displaced axially upward in direction A of FIG. 1. In particular, the upper crushing zone 603 is moved axially upward to extend the axial length of lower crushing zone 604 below the displaced choke zone 611.

The inventors have determined via assessment of the crusher dynamics and comparisons with field testing that the crusher capacity is determined by the volume of the choke zone. Importantly, the crusher dynamics assessment has confirmed that most of the crushing in the crusher within zone 104 is due to attrition (being inter-particle crushing). Additionally, material crushed within upper zone 603 is transferred to lower zone 602 by gravity and accordingly there is a mass balance between the crushing zones 603, 604. Consequently, the inventors have identified that the volume of material that is required to be crushed within lower zone 604 is controlled by the choke zone 607. If a compression ratio of material in zone 604 yields a higher force than a predetermined value of the crusher control system, the system will open the crushing zone 104 by effective separation of the shells 105, 106. Accordingly, there are two mechanisms to increase the compression, firstly, the crushing force between regions 600, 601, 602 must be increased or secondly, the volume of material within the lower crushing zone 604 must be decreased.

Accordingly, the inventors have identified that the problem of accomplishing reduction within a crusher is due to the fact that as the crusher reduces the crushing gap during gyroscopic procession, the size of the choke zone 607 and the size of the closed crushing zone 604 do not decrease by the same amounts. The result is that a conventional crusher will eventually allow transfer of more material from upper zone 603 to lower zone 604 than can be crushed in the lower zone 604 due to limitations in the available crushing force at this zone 604.

The present wedge 127 and channel 200 configuration of shell 106 is effective to decrease the amount of material within upper crushing zone 603 being available to be fed to the lower crushing zone 604. Accordingly, the present shell configuration restricts the volume of material to be crushed at the crushing zone 603 and effectively moves the choke zone 610, 611 axially upward. Accordingly, the choke zone 611 of the subject invention is proportionally smaller than zone 607 of conventional shells so as to balance crushing capacity with an effective increase in reduction. Importantly, wedges 127 do not extend into lower half 202 of crushing surface 117 such that the volume of the lower crushing zone 604 is unchanged relative to a conventional crusher arrangement.

Wedges 127 are therefore effective to allow the crusher to be operated at a smaller CSS without having to increase the crushing force. Where the crusher is operated according to a closed crushing circuit (coupled to a downstream screen) an increase in the process capacity is achieved as the size distribution of material exiting the crusher is substantially uniform and within the predetermined reduction range. That is, the need to purge the crusher due to choking is avoided together with the creation of very 'fine' particulates (due to over crushing within the lower crushing zone 604) being resultant from crusher choking.

Figure 7:
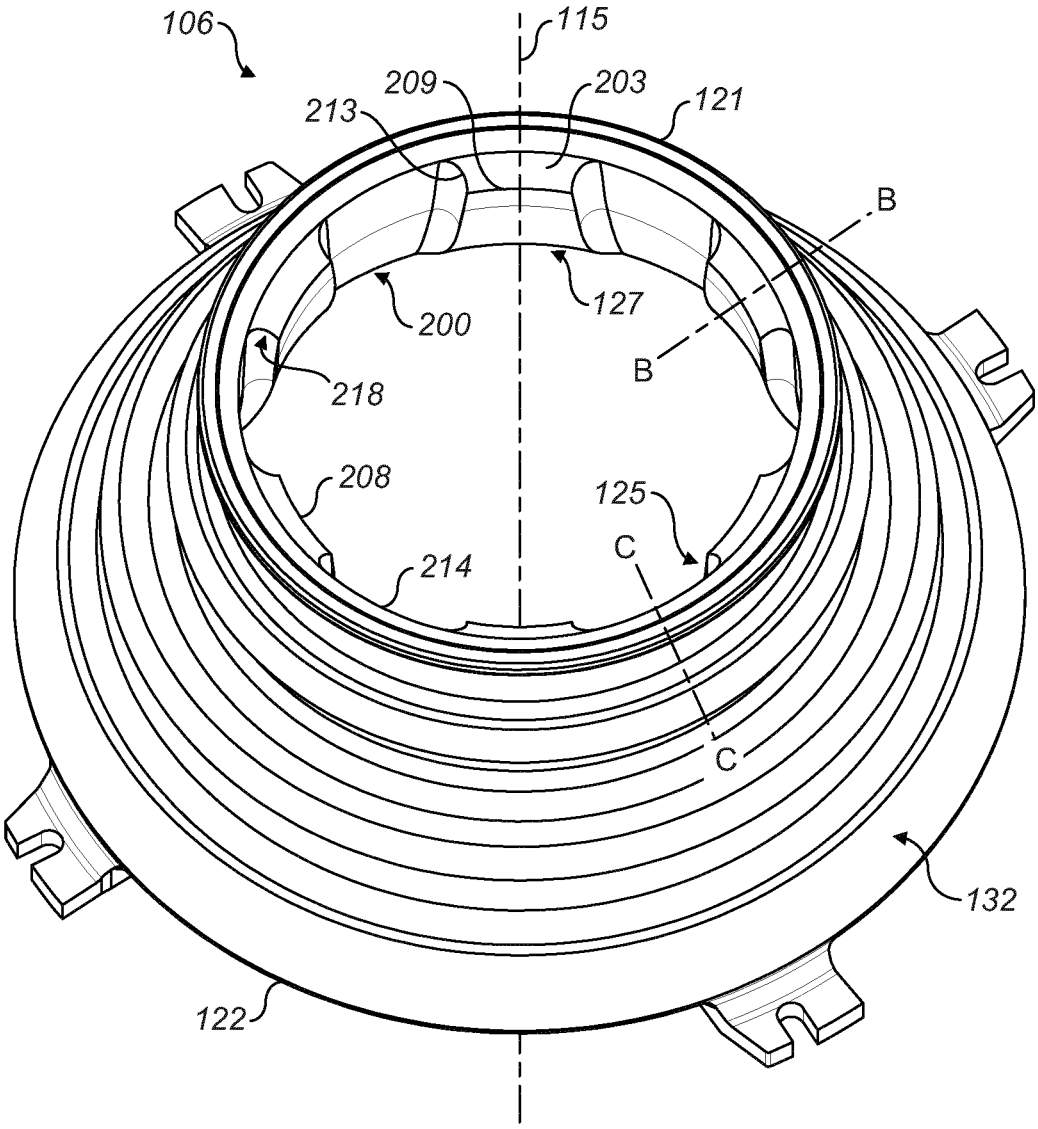
FIG. 7 is an upper perspective view of an outer crushing shell according to a further embodiment of the subject invention comprising a plurality of wedges projecting from the radially inward facing crushing surface.
Figure 8:
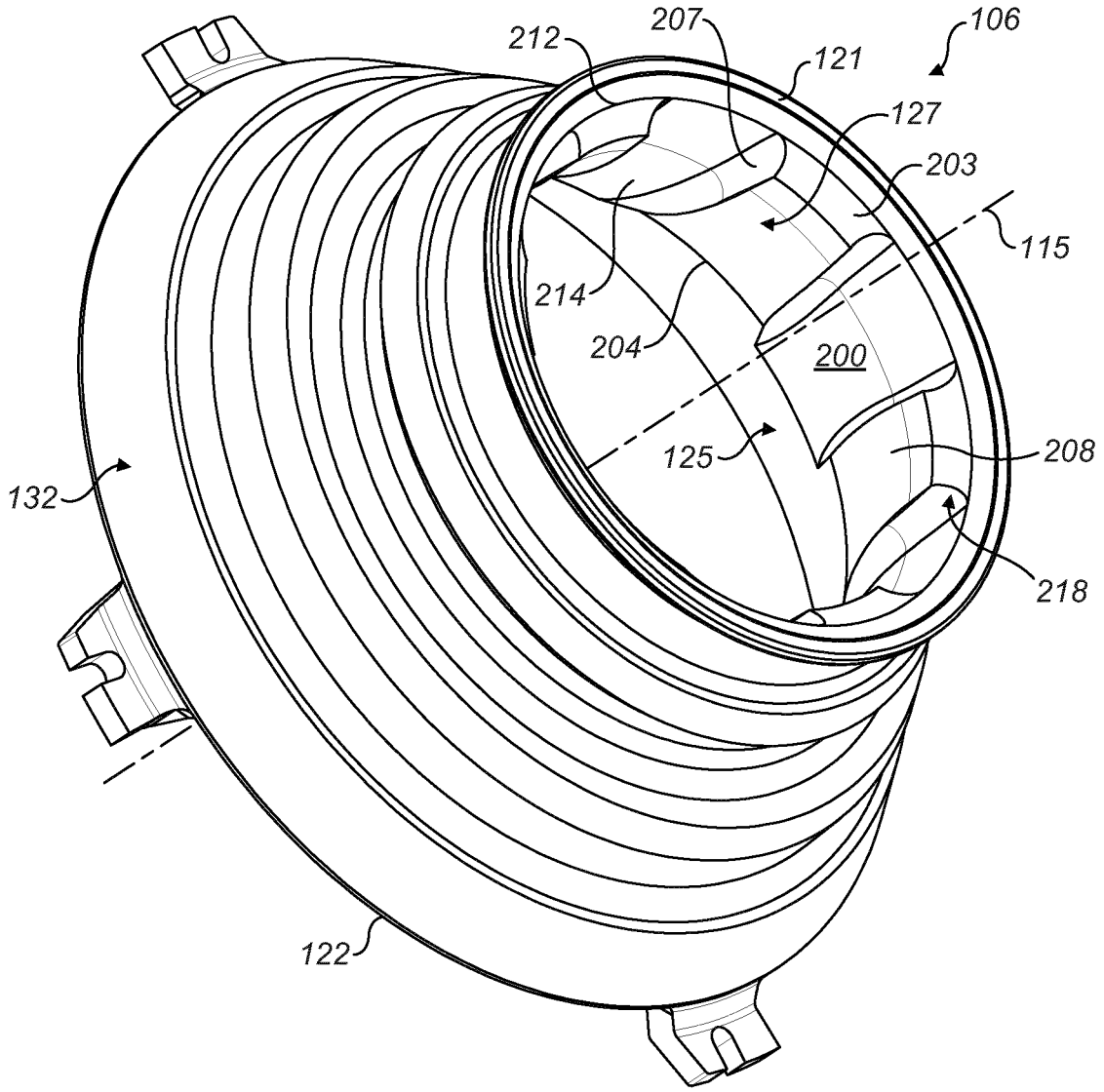
FIG. 8 is a further perspective view of the inner crushing shell of FIG. 7.

FIGS. 7 and 8 illustrate a further embodiment of the subject invention in which the outer crushing shell 106 comprises a plurality of axially extending wedges 127 projecting radially inward from the crushing surface 125. As will be noted wedges 127, shoulders 218 and channels 200 comprise the same geometry and general configuration as described with reference to FIGS. 2 to 5. That is, a radial extension of the wedges 127 decreases from the axially upper region corresponding to upper edge 209 to the axially lowermost region 204. The crushing surface 208 of each wedge 127 is therefore inclined at a greater angle than a corresponding crushing surface 214 of the channels 200 that extend circumferentially between the wedges 127. As detailed previously the wedges 127, in combination with the regions of the channels 200, provide that shell 106 comprises a crushing surface having a radial position relative to axis 115 that increases and decreases according to a uniform alternating profile in the circumferential direction around axis 115.

In particular, each wedge 127 is defined by a pair of axially extending side surfaces 207 that represent shoulders 218 defining each channel 200. Each of the left hand and right hand side surfaces 207 are identical to one another such that each wedge 127 is symmetrical about a vertical plane B-B extending axially through the shell wall 110. Similarly, each channel 200 is substantially symmetrical about a vertical plane C-C extending axially through shell wall 110.

Each channel 200 is accordingly defined by the pair of opposed side surfaces 207 of the shoulders 218 neighbouring wedges 127. Each side surface 207 comprises a generally wedge-shaped profile having a pointed lowermost end 217 and an uppermost end defined by the leading radial edge 213. As each wedge surface 208 tapers towards the radial position of each channel surface 214 in the axial direction from circumferential edge 209 to the lowermost region 204, side surfaces 207 also decrease in area from the uppermost radial edge 213 to the lowermost and thinnest end 217. Accordingly, a surface area of each side surface 207 that defines, in part, each channel 200 is substantially identical such that each channel 200 is symmetrical about plane C-C. Accordingly, material is directed to flow axially within each channel 200 and is prevented from passing circumferentially outward from each channel 200 by the axially extending shoulders 218. Each wedge 127 therefore acts to guide material to pass axially downward through each channel 200 by representing an obstruction to any circumferential flow of material within each channel 200. In particular, shoulders 218 ensure an axially downward flow of material is maintained and provide a means of guiding and retaining the material flow along each channel 200 from upper end 210 to lower end 211.

The invention claimed is:

1. A gyratory crusher inner crushing shell comprising:

a main body mountable within a crushing zone defined by a frame of a gyratory crusher, the main body extending around a central longitudinal axis, the main body having a mount surface for positioning opposed to the frame or a crusher head movably mounted within the crushing zone and a crushing surface arranged to contact material to be crushed, a wall defined by and extending between the mount and crushing surfaces, the wall having an axially upper first end and an axially lower second end;

a plurality of wedges projecting radially outward at the crushing surface and distributed in a circumferential direction around the central longitudinal axis, each of the plurality of wedges extending axially downward in an axial direction from below an axially upper region of the axially upper first end, and each of the plurality of wedges being terminated in the circumferential direction by a pair of lengthwise shoulders; and a plurality of axially extending channels defined by and positioned in the circumferential direction between the shoulders of opposed wedges, wherein the crushing surface at the region of each of the plurality of wedges has a concave shaped profile in the axial direction, each of the plurality of wedges being positioned below the axially upper region so as to not extend into an axially lower region of the crushing surface.

2. The crushing shell as claimed in claim 1, wherein a radial distance of the crushing surface relative to the central longitudinal axis at an axial position of the wedges and channels increases and decreases according to an alternating profile in the circumferential direction around the central longitudinal axis.

3. The crushing shell as claimed in claim 2, wherein the wedges extend axially to a region halfway between the axially upper first end and the axially lower second end, such that the axially lower region of the shell is devoid of the wedges and the channels.

4. The crushing shell as claimed in claim 1, wherein a radial distance between the crushing surface of each wedge of the plurality of wedges and the crushing surface of each channel decreases in the axially downward direction from the region of the axially upper first end to the axially lower second end.

5. The crushing shell as claimed in claim 1, wherein the wall includes a radial thickness that is uniform at a region of each wedge in the axial direction from the region of the axially upper first end to the axially lower second end.

6. The crushing shell as claimed in claim 1, wherein a radial thickness of each wedge or the wall is uniform in the circumferential direction between the shoulders.

7. The crushing shell as claimed in claim 1, wherein a radial thickness of the wall at each channel is uniform in the circumferential direction between the shoulders.

8. The crushing shell as claimed in claim 7, wherein each side surface has a concave curvature arranged to provide a transition between the crushing surface and each wedge and the crushing surface of each channel.

9. The crushing shell as claimed in claim 1, wherein a width of each channel in the circumferential direction around the central longitudinal axis is substantially equal to a width of each wedge in the circumferential direction around the central longitudinal axis.

10. The crushing shell as claimed in claim 1, wherein a width of each wedge in a circumferential direction around the central longitudinal axis increases in the axial direction from the region of the first to the second end.

11. The crushing shell as claimed in claim 1, comprising between three to ten wedges distributed circumferentially around the central longitudinal axis.

12. The crushing shell as claimed in claim 1, wherein the crushing shell is an outer crushing shell arranged for being positioned opposed to the frame such that the wedges are provided at a radially inward facing surface of the outer crushing shell.

13. The crushing shell as claimed in claim 12, wherein a thickness of the wall is uniform in the circumferential direction around the axis within the axially upper region.

14. The crushing shell as claimed in claim 1, wherein the crushing shell is an inner crushing shell arranged for being positioned opposed to the crusher head and the wedges are provided at a radially outward facing surface of the inner crushing shell.

15. The crushing shell as claimed in claim 1, further comprising a plurality of recesses disposed in the mount surface, each of the plurality of recesses having a position corresponding to a position directly behind a respective one of the plurality of wedges.

16. A gyratory crusher comprising:

a frame;

a crushing zone defined by the frame;

a crusher head; and at least one inner crushing shell, the inner crushing shell including a main body mountable within the crushing zone, the main body extending around a central longitudinal axis, the main body having a mount surface for positioning opposed to the frame or the crusher head movably mounted within the crushing zone and a crushing surface arranged to contact material to be crushed, a wall defined by and extending between the mount and crushing surfaces, the wall having an axially upper first end and an axially lower second end, a plurality of wedges projecting radially outward at the crushing surface and distributed in a circumferential direction around the central longitudinal axis, each of the plurality of wedges extending axially downward in an axial direction from below an axially upper region of the axially upper first end, and each of the plurality of wedges being terminated in the circumferential direction by a pair of lengthwise shoulders, and a plurality of axially extending channels defined by and positioned in the circumferential direction between the shoulders of opposed wedges wherein the crushing surface at the region of each of the plurality of wedges has a concave shaped profile in the axial direction, each of the plurality of wedges being positioned below the axially upper region so as to not extend into an axially lower region of the crushing surface.

17. The crusher shell as claimed in claim 16, wherein the at least one crushing shell includes an outer crushing shell arranged for being positioned opposed to the frame, such that the plurality of wedges is provided at a radially inward facing surface of the outer shell.

18. The crusher shell as claimed in claim 16, wherein the at least one crushing shell includes an inner crushing shell arranged for being positioning opposed to the crushing head and the plurality of wedges is provided at a radially outward facing surface of the inner shell.

* * * * *